United States Patent [19]

Knight

[11] Patent Number: 4,897,074

[45] Date of Patent: Jan. 30, 1990

[54] MECHANISM FOR JOINING A CARRIER TAPE COVER TO A BASE STIP

[75] Inventor: Richard K. Knight, Arlington, Tex.

[73] Assignee: Illinois Tool Works Inc., Chicago, Ill.

[21] Appl. No.: 194,938

[22] Filed: May 17, 1988

[51] Int. Cl.[4] ..... B65H 37/04; B65H 37/00; B65B 11/50

[52] U.S. Cl. ..... 493/381; 53/116; 53/281; 53/559; 493/136; 493/139; 493/390

[58] Field of Search ..... 493/136, 137, 139, 140, 493/381, 386, 390; 53/116, 281, 559

[56] References Cited

U.S. PATENT DOCUMENTS 4,733,778 3/1988 Boeckmann et al. ..... 206/328
4,753,061 6/1988 Braden et al. ..... 53/471

*Primary Examiner*—Frederick R. Schmidt
*Assistant Examiner*—Jack W. Lavinder
*Attorney, Agent, or Firm*—John P. O'Brien; Thomas W. Buckman

[57] ABSTRACT

A carrier tape system includes an elongated base strip and an elongated cover strip both formed of a plastic film material. The cover strip is substantially coextensive in length with the base strip. The cover strip has a top surface and opposed sidewalls extending downwardly from the top surface. The opposed sidewalls are spaced apart from each other a distance substantially equal to the width of the base strip. The cover strip further includes a hump projecting upwardly from the top surface and extends longitudinally in a parallel relationship to the sidewalls. Each of the sidewalls has an inwardly extending hooked portion formed integrally therewith. The hooked portion has its top surface spaced beneath the edge of the base strip to form a U-shaped recess to secure the cover strip to the base strip. A mechanism for forming the carrier tape system is provided by making modifications to existing carrier tape joining apparatuses.

16 Claims, 6 Drawing Sheets

MECHANISM FOR JOINING A CARRIER TAPE COVER TO A BASE STIP

BACKGROUND OF THE INVENTION

This invention relates generally to carrier tapes and more particularly, it relates to an improved carrier tape system for transporting electronic components, pharmaceuticals, and the like during production and assembly operations. In addition, there is provided an apparatus for forming the improved carrier tape system which is achieved by making modifications to an existing carrier tape joining device.

As is generally known, carrier tapes are commonly used to transport miniature or subminiature components or products from one station to another in production and assembly operations. Such carrier tapes are typically formed of a base strip of plastic, paper or the like and a cover strip. The base strip is formed with a plurality of cavities or pockets for holding the components and the cover strip is secured to the base strip so as to avoid accidental falling of the components from the cavities. Heretofore, the cover strip was most commonly held in place by an adhesive, heat bond or spaced snap-type fasteners. Typical examples of these types of prior art carrier tapes are disclosed in U.S. Pat. Nos. 3,465,874; 3,650,430; 3,700,019; 3,894,896; 3,910,410; and 4,298,120.

In addition to the above patents, there are various prior art carrier tapes which utilize a continuous mechanical interlock for securing together the base strip and the cover strip. For instance, in application Ser. No. 913,131 filed on Sept. 25, 1986, and entitled "Reuseable Carrier Tape," there is disclosed a carrier tape construction in which the base and cover strips are uniformly and consistently secured to each other. At least one of the strips is provided with an integrally formed, longitudinally extending continuous profile which cooperates with surfaces of the other strip to secure the two strips in a locking engagement. In application Ser. No. 008,293 filed on Jan. 29, 1987, and entitled "Carrier Tape," which is a continuation-in-part of application Ser. No. 913,131, there is disclosed a carrier tape which includes an elongated base strip, an elongated cover strip, and at least one elongated profile strip bonded to one of the other strips, preferably the base strip. The profile strip is provided with a longitudinally extending continuous, integrally formed profile which cooperates with the surfaces of the cover strip to secure the base and cover in a locking engagement. This application Ser. No. 008,293 has now matured into U.S. Pat. No. 4,708,245 on Nov. 24, 1987.

In application Ser. No. 046,259 filed on May 4, 1987, and entitled "Improved Carrier Tape and Cover Applying and Removal Devices For Same," which is a continuation-in-part of application Ser. No. 008,293, there is disclosed an improved carrier tape comprising an elongated base strip and an elongated cover strip both formed of a plastic film material. The base strip is provided with longitudinally spaced cavities for components to be transported therein as well as a series of spaced, longitudinally extending sprocket drive holes for advancing the tape through an associated assembly machine. The cover strip has sidewalls extending downwardly and terminating in inwardly directed barbs or profiles. The spacing between the sidewalls is substantially equal to the width of the base strip. A raised, longitudinally extending hump is provided projecting upwardly from the top surface of the cover strip. When the hump is depressed, the sidewalls of the cover strip move laterally outwardly so as to clear the edges of the base strip and thus permit removal of the cover strip. On the other hand, when the hump is released, the sidewalls return to their relaxed positions securely interlocking with the base strip edges.

Further, there is described in application Ser. No. 046,259 a device for applying the cover strip to the base strip which includes means for applying pressure to the hump of the cover strip and means for guiding the sidewalls of the cover strip around the edges of the base strip. All of the previously mentioned application Ser. Nos. 913,131; 008,293; and 046,259 are assigned to the same assignee as this invention and are hereby incorporated by reference.

In use, the prior art carrier tapes are usually wound around a storage reel for shipping and handling. As a result, there have been encountered heretofore the development of stresses between the base strip and the cover strip as they are wrapped onto the storage reel. This is caused by the tension variations produced by the reel which affects the carrier tape closer at the center of the reel differently than the portions of the carrier tape further away from the center. Consequently, the base and cover strips tend to slip or stretch with respect to one another during the winding process, thereby effecting a premature separation between the base strip and the cover strip at certain portions of the carrier tape and thus rendering possible loss of components. All of the various prior art methods of securing the base strip and the cover strip previously discussed (i.e., either by adhesion or mechanical interlock) suffer from this problem of stresses created during the assembly operation.

Accordingly, it would therefore be desirable to provide an improved carrier tape system in which the base strip and the cover stip are mechanically interengaged so that they are permitted to slide or creep relative to each other when wound around a storage reel. It would be also expedient to provide an apparatus for mechanically interconnecting the base and cover strips of such carrier tape system to each other.

SUMMARY OF THE INVENTION

Accordingly, it is a general object of the present invention to provide an improved carrier tape system which is relative simple and economical to manufacture and assemble, but yet overcomes the disadvantages of prior art carrier tapes.

It is an object of the present invention to provide a carrier tape system which includes a base strip and a cover strip having first and second inwardly extending hooked portions for securement to the base strip.

It is another object of the present invention to provide an improved carrier tape system in which the base strip and the cover strips are mechanically interengaged so that they are permitted to slide or creep relative to each other.

It is still another object of the present invention to provide an apparatus for mechanically interconnecting the base and cover strips of a carrier tape system to each other.

It is yet still another object of the present invention to provide an apparatus for forming a carrier tape system which can be achieved by making modifications to an existing carrier tape joining device.

In accordance with these aims and objectives, the present invention is concerned with the provision of an improved carrier tape system which includes an elongated base strip and an elongated cover strip which is substantially coextensive in length with the base strip. The cover strip has a top surface and opposed sidewalls extending downwardly from the top surface. The opposed sidewalls are spaced apart from each other a distance substantially equal to the width of the base strip. The cover strip further includes a hump projecting upwardly from the top surface and extending longitudinally in a parallel relationship to the sidewalls.

Each of the sidewalls is provide with an inwardly extending hooked portion formed integrally therewith. The hooked portion has its top surface spaced beneath the edge of the base strip to form a U-shaped recess to secure the cover strip to the base strip. In the assembled condition, the edges of the base strip are loosely retained in the respective U-shaped recesses of the cover strip so as to permit the base and cover strips to slide relative to each other when the carrier tape system is wound on a storage reel. This serves to eliminate the development of stresses which could cause a premature separation of the base and cover strips.

In another aspect of the present invention, there is provided a mechanism for joining a carrier tape cover strip to a base strip which includes a first guide device for receiving the base strip, a second guide device arranged in a position over the first guide device for receiving the cover strip above the base strip, and a sealing device. The sealing device is utilized for gradually guiding a first hooked portion of the cover strip over a first edge of the base strip and for subsequently snapping a second hooked portion of the cover strip over a second edge of the base strip.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 2:
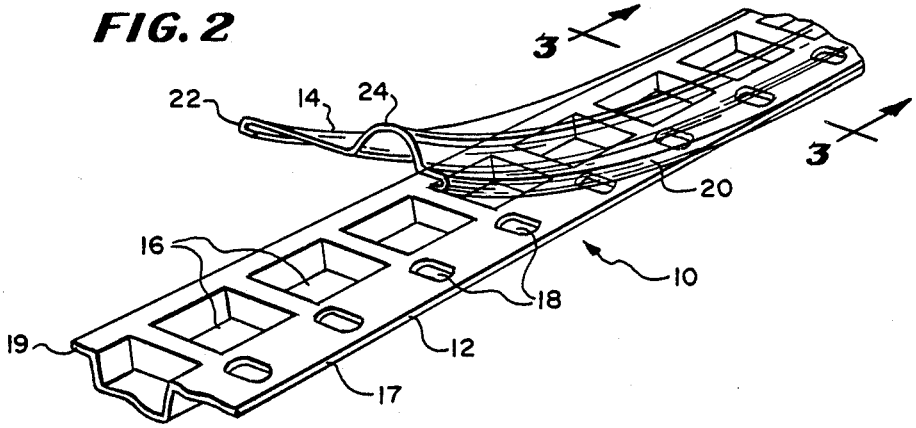
FIG. 2 is a fragmentary, perspective view of a carrier tape system, constructed in accordance with the principles of the present invention.

Referring now in detail to the various views of the drawings, there is shown in FIG. 2 a fragmentary, perspective view of a carrier tape system 10, constructed in accordance with the present invention. The carrier tape system 10 is comprised of an elongated base strip 12 and a generally coextensive cover strip 14. The carrier tape system 10 is preferably formed of a suitable plastic film material such as carbon loaded polyvinyl chloride, polypropylene or a glycol-based polyester such as polyethylene terephthalate (PETG) which may be readily extruded and vacuum or pressure formed to the desired shape. The carrier tape resin may be formulated with appropriate additives to render the base and cover strips anti-static or static dissipative as may be required. The carrier tape system should be sufficiently flexible to permit it to be spooled or wound on a storage reel.

The base strip 12 is formed with a plurality of cavities 16 which define individual pockets for the components to be conveyed therein. In this regard, the cavities 16 may be contoured, as required, to maintain the components in a particular orientation, should such orientation be necessary. A series of aligned sprockets holes 18 is provided extending through the base strip 12, adjacent to and outward of the cavities 16. The base strip 12 further includes a first edge 17 disposed outwardly of the sprocket holes 18 and a second edge 19 disposed outwardly of the cavities 16. As thus far described, the base strip 12 of the carrier tape system 10 is identical to the base strip described and illustrated in the previously mentioned application Ser. No. 046,259.

The cover strip 14 is coextensive in length with the base strip 12. The cover strip 14 is provided, at each side, with downwardly extending sidewalls 20 and 22. The sidewalls 20,22 are spaced apart from each other a distance substantially equal to the width of the base strip 12. The cover strip 14 also includes a longitudinally extending upwardly projecting hump 24 along its entire length. The hump 24 is used to provide a "living hinge" for major portion 26 and minor portion 28 of the top face of the cover strip 14 defined on opposite sides of the hump.

Figure 3:
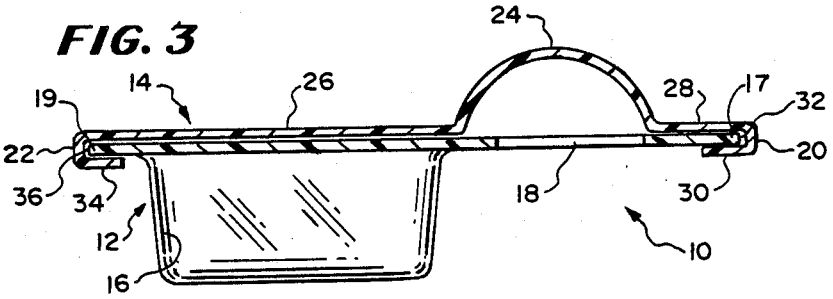
FIG. 3 is a side elevational view of the carrier tape system of FIG. 2, taken along the lines 3—3.

The sidewall 20 has formed integrally therewith an inwardly extending hooked portion 30. The undersurface of the cover strip 14 adjacent the sidewall 20 and the top surface of the hooked portion 30 form a continuous longitudinally extending U-shaped recess or slot 32. Similarly, the sidewall 22 has formed integrally therewith an inwardly extending hooked portion 34. The undersurface of the cover strip 14 adjacent the sidewall 22 and the top surface of the hooked portion 34 form a continuous longitudinally extending U-shaped recess or slot 36. The sizes of the U-shaped recesses 32 and 34 are such that when the cover strip 14 is mechanically interengaged with the base strip 12 the major portion 26 of the cover strip will cover a component (not shown)

within the cavity 16 while the edges 17, 19 of the base strip are received within the recesses 32 and 36, as best seen from FIG. 3. Further, in the assembled condition the hump 24 is positioned to be aligned over the line of sprocket holes 18 thereby providing clearance for engaging the protruding teeth of a sprocket drive wheel of an assembly mechanism with which the carrier tape system is to be used.

It should be appreciated that the carrier tape system 10 of the present invention has eliminated the use of an adhesive bond or a mechanical interlock (snap-fit type) for tightly securing the base strip and the cover strip. On the contrary, in order to overcome the problem of stresses encountered in the prior art carrier tapes when wound on a storage reel, the edges 17, 19 of the base strip 12 are loosely retained in their respective U-shaped recesses 34,36 of the present cover strip 14 so as to permit the base and cover strips to slide or creep relative to each other during the assembly operation. It will be apparent to those skilled in the art that the cover strip 14 must have a "leader" portion on each end of its length so that the base strip 12 is shorter in length. In other words, the base strip 12 is free to slide or stretch within the cover strip 14 along the recesses 32, 36 so as to overcome any stresses tending to separate the assembled carrier tape system 10.

Figure 1:
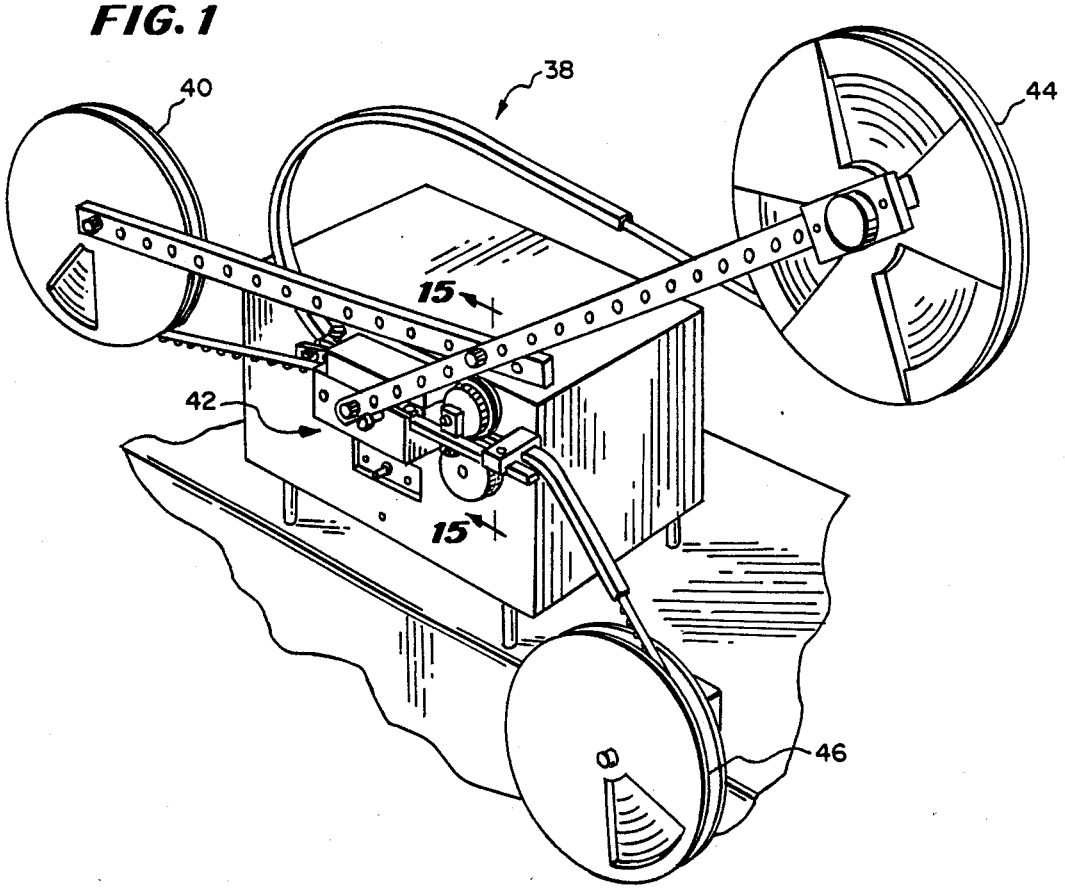
FIG. 1 is a perspective view of an apparatus for joining a base strip to a cover strip, constructed in accordance with the principles of the present invention.

An apparatus or mechanism 38 for joining the base strip 12 and the cover strip 14 of the present carrier tape system 10 is illustrated in FIG. 1. In general, the base strip 12 is fed from a supply reel 40, the cavities 16 thereof being loaded with components (not shown), and is brought horizontally to a joining station 42. The cover strip 14 is fed from a supply reel 44 and is also brought to the joining station 42 where it is applied to the base strip 12. The assembled carrier tape system 10 is then drawn off and wound on a take-up reel 46 for subsequent shipment and use. The present invention envisions the modification or retrofitting of existing carrier tape joining apparatuses by replacing of several components at its joining station so as to accommodate the assembly of the present base and cover strips. The structural details and their operation at the joining station 42 of the present apparatus 38 for effecting the joining of the base and cover strips are shown in FIGS. 1 and 4 through 15.

Figure 4:
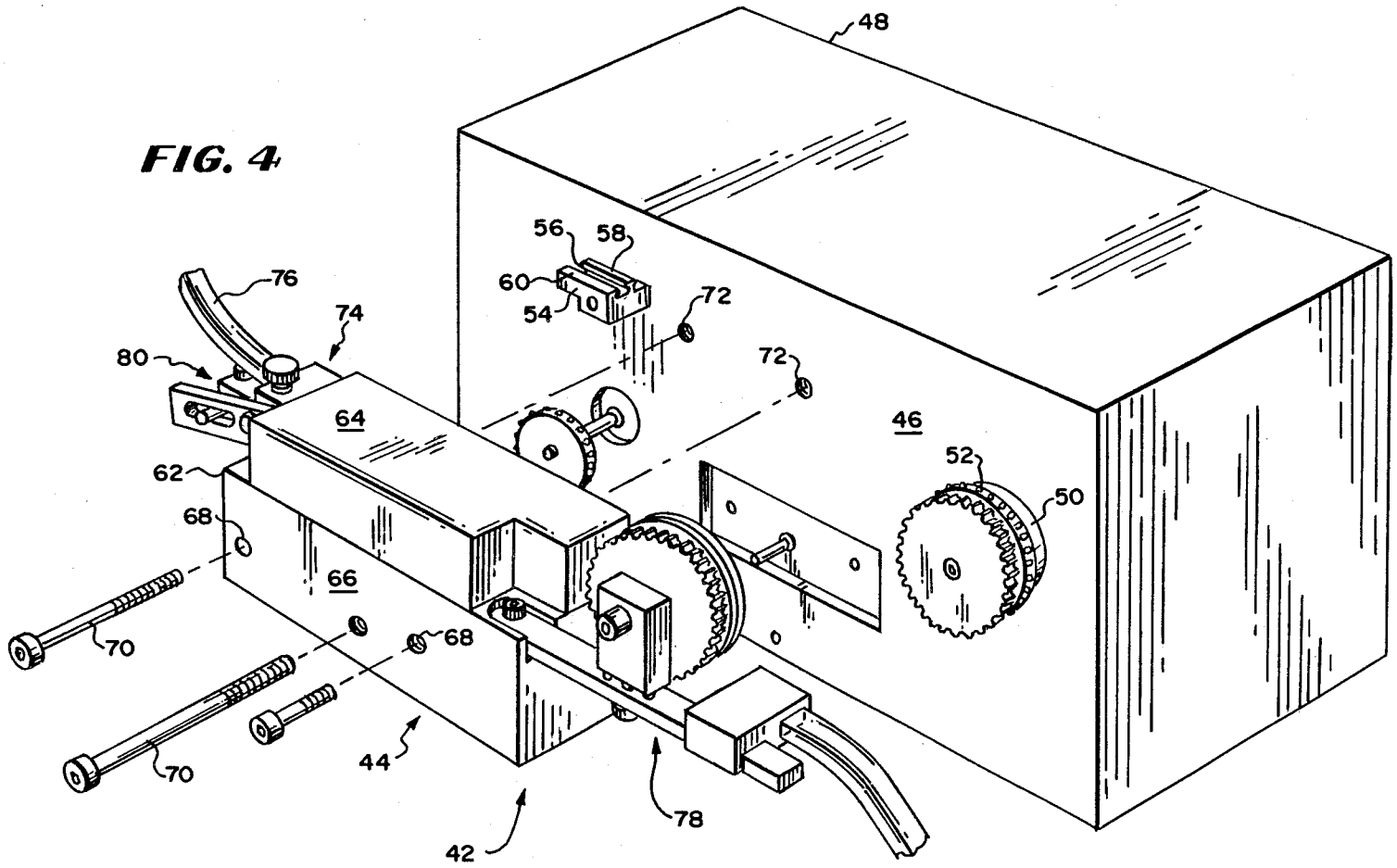
FIG. 4 is an exploded, perspective view of a portion of the apparatus shown in FIG. 1.

As can be seen in FIG. 4 of the drawings, there is shown an enlarged, exploded perspective view of a portion of the apparatus 38 depicted in FIG. 1. The joining station 42 includes a sealer unit 44 which is adapted for mounting to the side 46 of the main housing 48 of the apparatus 38. The main housing 48 includes a sprocket drive wheel 50 having protruding teeth 52 for engaging the sprocket holes 18 in the base strip 12 so as to advance the same. The main housing 48 also includes a base strip guide member 54 having a central groove 56 for receiving the base strip 12. The central groove 56 has a depth sufficient to provide clearance for the bottom of the component cavities 16 while the undersurfaces of the edges 17, 19 of the base strip rest on edges 58, 60 that define the groove 56. The drive sprocket wheel 50 and the guide member 54 are considered to be already present in existing carrier tape joining apparatuses.

The sealer unit 44 of the present invention comprises an enclosed housing 62 formed of an upper cover section 64 and a lower base portion 66. The lower base portion 66 is provided with openings 68 for receiving therethrough fastener means, such as threaded bolts 70 to be threaded into internally threaded recesses 72 formed in the side 46 of the main housing 48. At the left end of the sealer unit 44, as viewed in FIGS. 4–6, a cover strip guide device 74 is suitably interconnected between a tubular guide member 76 and the sealer unit 44 for delivering the cover strip 14 into the sealer unit. At the right end of the sealer unit 44, a cover strip pulling mechanism 78 is suitably connected for pulling the cover strip 14 through the sealer unit 44 at the same rate as the base strip 12 is advanced by the sprocket wheel 50. A mechanical interface unit 80 is provided for interconnecting operatively the guide members 54 and 74 so that when the sealer unit 44 is mounted to the housing 48 the guide device 74 is located in alignment above and upstream of the guide member 54.

Figure 7:
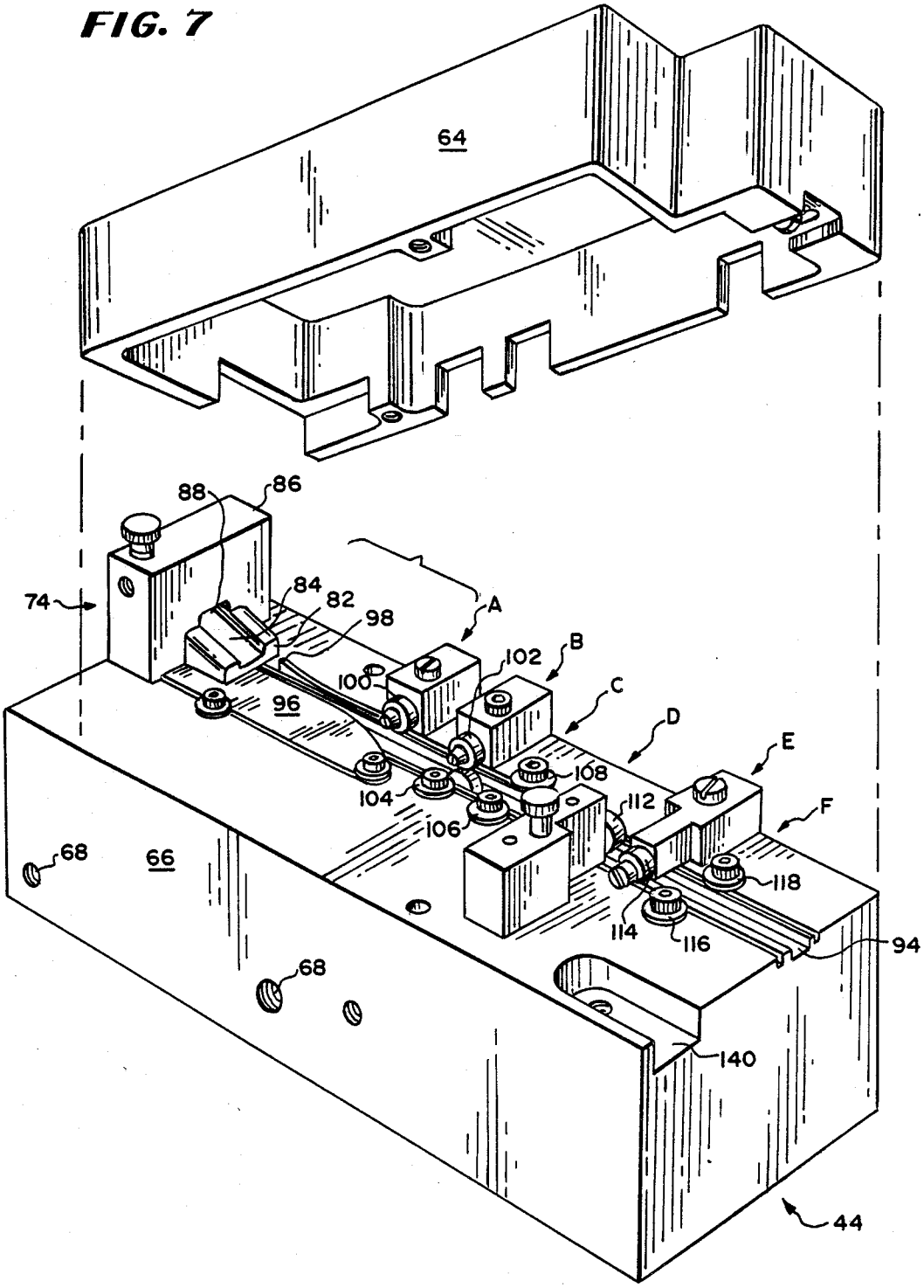
FIG. 7 is an exploded, perspective view of the sealer unit 44 of FIG. 4.
Figure 8:
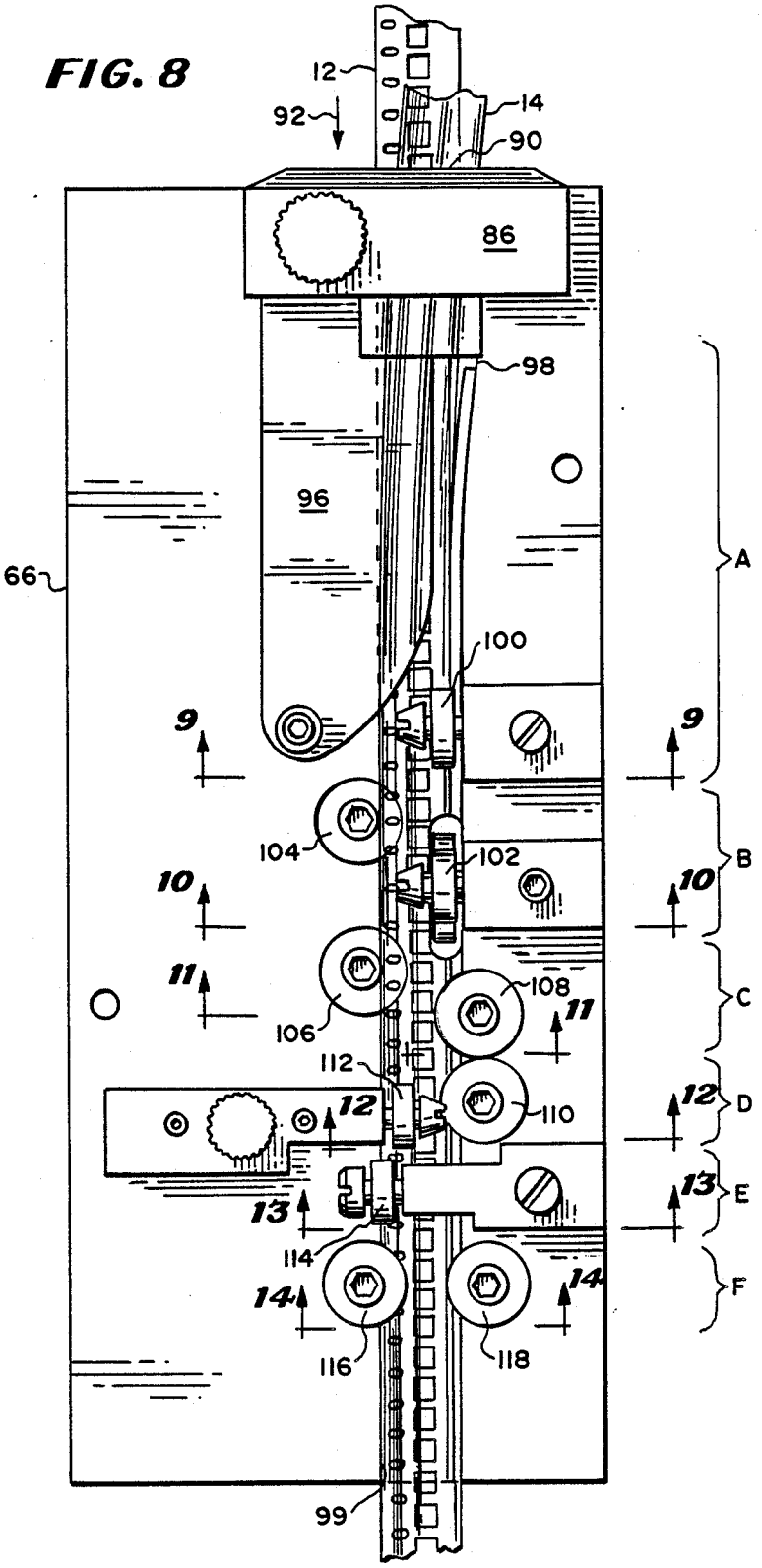
FIG. 8 is a top plan view of the lower housing of the sealer unit 44 of FIG. 7.

In FIG. 7, the upper cover section 64 has been removed from the lower base portion 66 of the enclosed housing 62 so as to show the structural components used in zones A–F for joining or sealing of the cover strip 14 to the base strip 12. FIG. 8 is a top view of the lower base section 66 of FIG. 7. The cover strip guide device 74 includes a raised inwardly sloping plate member 82 which has a contoured channel 84 for receiving the cover strip 14 and a top member 86 positioned over the plate member 82. The top member 86 is provided with a recess 88 aligned above the channel 84 for capturing the cover strip 14 therebetween.

As can be seen in FIG. 8, the cover strip guide device 74 conducts the cover strip 14 at a point 90 upstream from the point at which the base strip enters the base cover guide member 54 (FIG. 4) of the main housing. At the point 90 where the cover strip enters the sloping plate member 82 of the guide device 74, the cover strip 14 is disposed at an angle of approximately $2–4^0$ relative to the longitudinal path of travel of the base strip 12, as designated by an arrow 92. The base strip 12 at the point 90 begins to enter a longitudinal channel 94 formed in the lower base section 66 of the sealer unit. A thin arcuate guide plate or shim 96 is positioned in the zone A between the sloping plate member 82 and the longitudinal channel 94.

Figure 9:
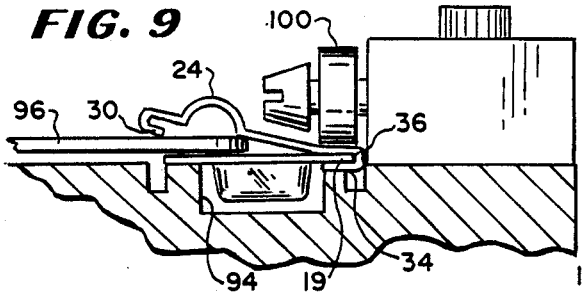
FIG. 9 is a cross-sectional view of the lower housing section 66 of FIG. 8, taken along the lines 9—9.

At the point 98 in the zone A, the cover strip 14 leaves the sloping guide member 82 and rides on the top surface of the arcuate plate 96 while the base strip 12 moves along in the longitudinal channel 94 beneath the surface of the arcuate plate 96. At this point 98, the arcuate plate 96 facilitates the gradual guiding of the hooked portion 34 of the cover strip 14 over the edge 19 of the base strip 12 with only a very slight force. In FIG. 9, there is shown a cross-sectional view at the end of the zone A in which the edge 19 of the base strip 12 is mechanically engaged within the U-shaped recess 36 of the cover strip 14. Further, it will be noted that the edge 19 is held in contact within the recess 36 in their overlapping position by a pressure roller 100 while the hump 24 and hooked portion 30 of the cover strip is maintained above the base strip by the arcuate plate 96.

Figure 10:
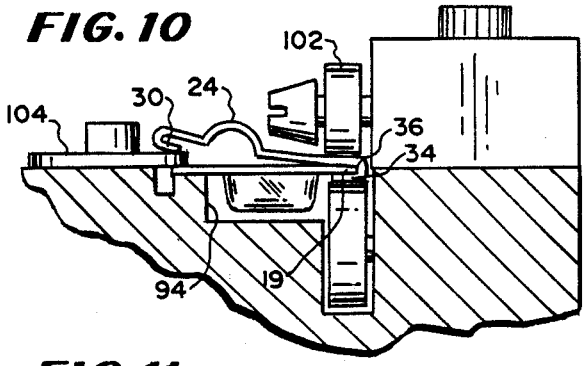
FIG. 10 is a cross-sectional view of FIG. 8, taken along the lines 10—10.
Figure 11:
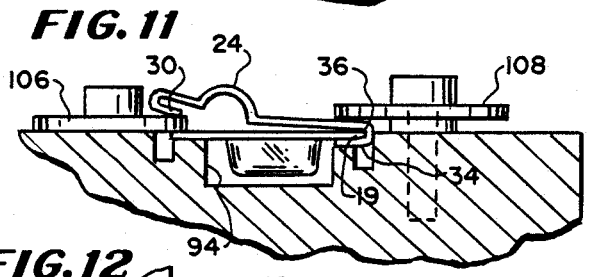
FIG. 11 is a cross-sectional view of FIG. 8, taken along the lines 11—11.

In FIG. 10, there is illustrated a cross-sectional view of the zone B in which the edge 19 is continued to be held in place within the recess 36 by a pressure roller 102. However, the hump 24 and the hooked portion 30 of the cover strip is maintained above the base strip by a guide roller 104 supporting only the underneath surface of the hooked portion 30. In FIG. 11, there is depicted a cross-sectional view of the zone C in which a guide roller 106 is used to continue the supporting of the underneath surface of the hooked portion 30 while the edge 19 disposed in the recess 36 is passed underneath a raised guide roller 108 for holding it in place.

Figure 12:
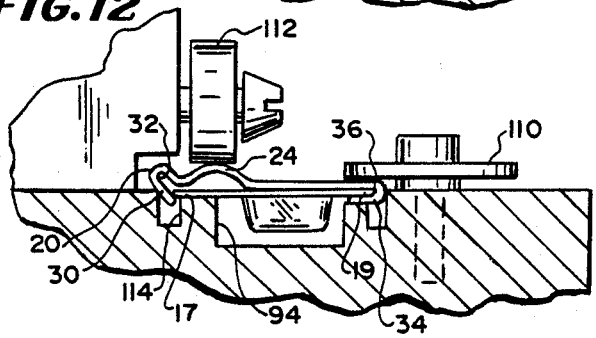
FIG. 12 is a cross-sectional view of FIG. 8, taken along the lines 12—12.

In FIG. 12, there is illustrated a cross-sectional view of the zone D in which the edge 19 within the recess 36 is further passed under a raised guide roller 110 for maintaining together the same. The hump 24 is passed under a vertically aligned pressure roller 112 which applies pressure thereto. As a consequence, the sidewall 20 and the hooked portion 30 are caused to move laterally outwardly as shown in FIG. 12 in which the hooked portion 30 rides in an angular position within a channel 114. Pressure is removed or released from the hump 24 when it leaves the pressure roller 112 in the zone D. As a result, the resiliency of the sidewall 20 coupled with the hinge action of the hump 24 will cause the hooked portion 30 to snap inwardly towards and over the edge 17 of the base strip 12, thereby engaging the edge 17 within the U-shaped recess 32.

Figure 13:
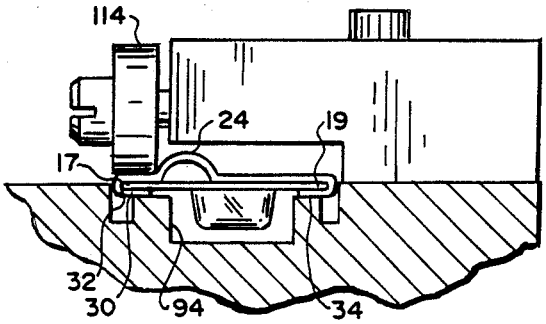
FIG. 13 is a cross-sectional view of FIG. 8, taken along the lines 13—13.
Figure 14:
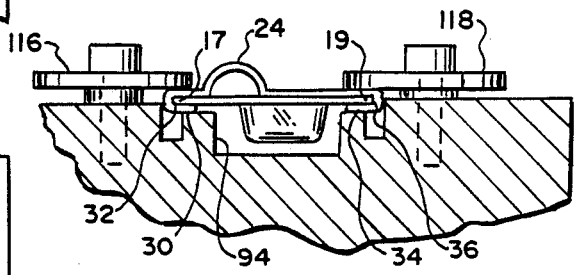
FIG. 14 is a cross-sectional view of FIG. 8, taken along the lines 14—14.

In FIG. 13, there is depicted a cross-sectional view of the zone E in which the edge 17 within the recess 32 is passed underneath a pressure roller 114 so as to maintain together the assembled cover tape system 10. In FIG. 14, there is shown a cross-sectional view of the zone F adjacent the exit end 116 of the sealer unit 44 in which oppositely disposed raised guide rollers 116, 118 are provided so as to maintain the respective edge 17, 19 of the base strip 12 within the corresponding recesses 32, 36 of the cover strip 14, thereby producing the assembled tape carrier system as it leaves the sealer unit.

Figure 5:
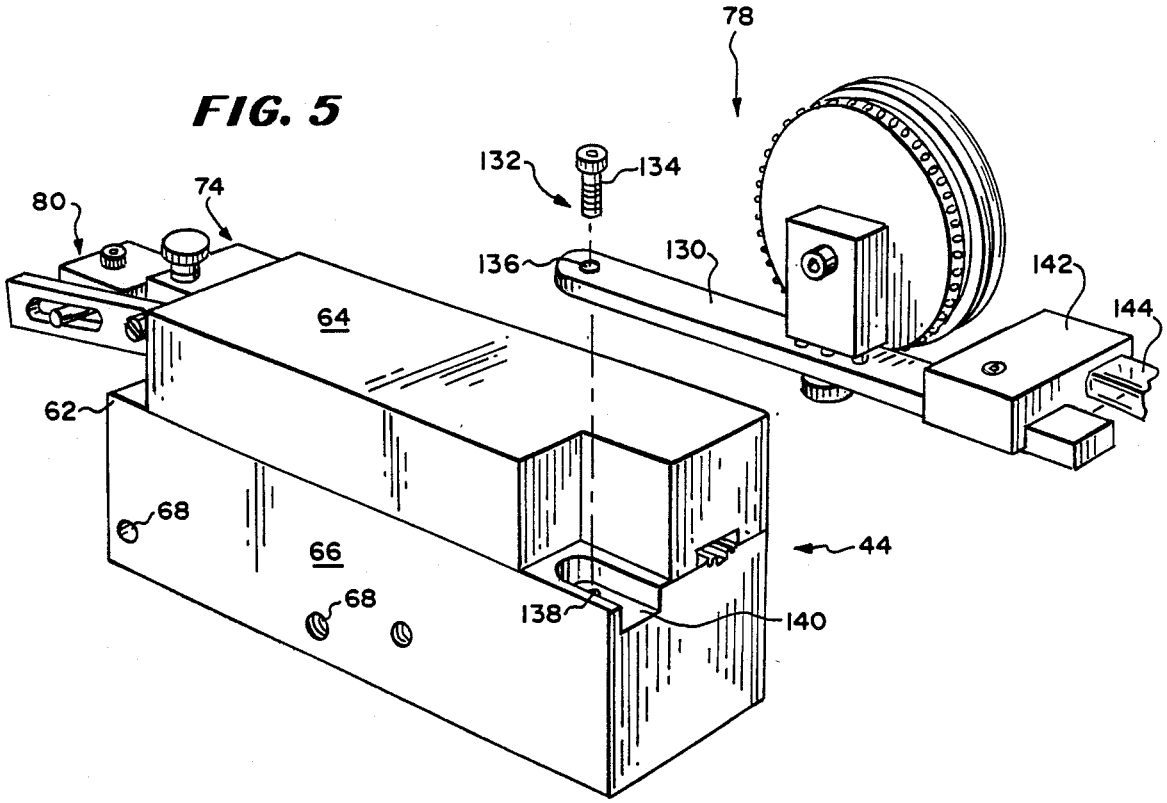
FIG. 5 is an exploded, perspective view of a portion of the sealer unit 44 and the pulling mechanism 78 shown in FIG. 4.
Figure 6:
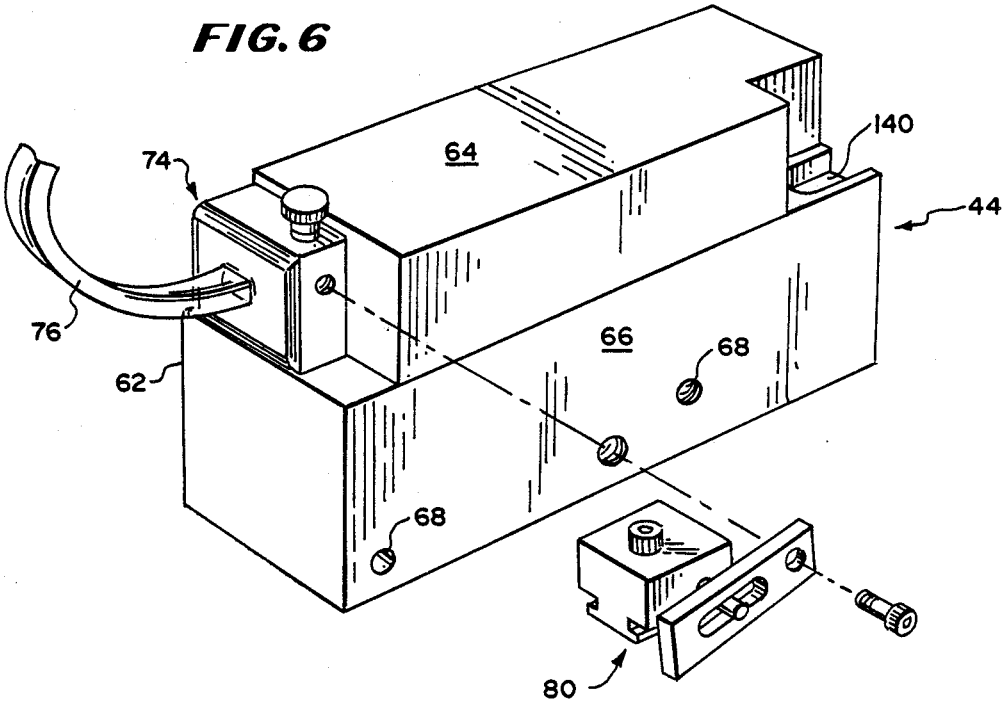
FIG. 6 is an exploded, perspective view of the sealer unit 44, the guide member 74, and interface unit 80 of FIG. 4.
Figure 15:
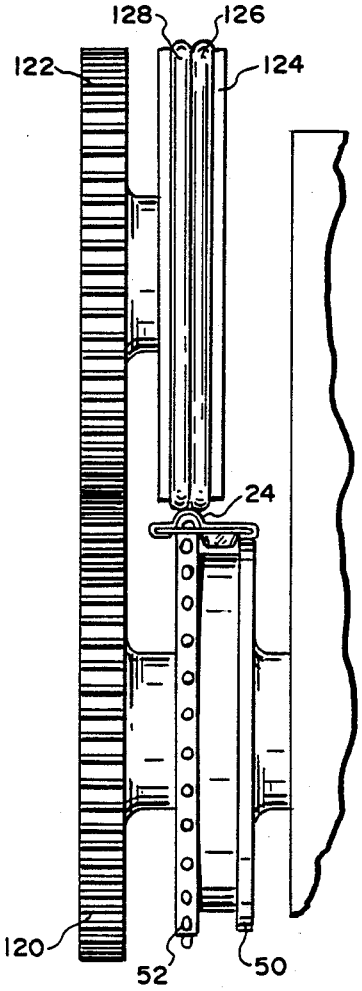
FIG. 15 is a cross-sectional view of the pulling mechanism 78 of FIG. 1, taken along the lines 15—15.

In order to prevent the assembled carrier tape system 10 from separating as it is wound on the take-up storage reel 46, the cover strip pulling mechanism 78 shown in FIGS. 5 and 15 is provided so as to pull the cover strip 14 through the sealer unit 44 at the same rate as the base strip 12 is advanced or driven by the drive sprocket wheel 50. As can best be seen in FIG. 15, the pulling mechanism 78 includes a drive gear 120 mechanically coupled to the sprocket wheel 50 and a driven gear 122 meshed with the drive gear 120. A driven assist wheel 124 is mechanically coupled to the driven gear 122 so that it is driven in synchronization with the drive sprocket wheel 50. The driven wheel 124 is formed with rubber or other flexible O-type rings 126, 128 located in grooves (not shown). The O-type rings contact the opposite sides of the hump 24 so as to assist in driving or pulling of the cover strip 14 through the sealer unit 44 at the same speed as the base strip 12.

As can be seen from FIG. 5, the pulling mechanism 78 is mounted above a rectangularly-shaped bar member 130 in its intermediate area. One end of the bar member 130 is affixed to the right end of the sealer unit 44 via suitable fastening means 132. The fastener means 132 includes a threaded bolt 134 which is passed through an opening 136 in the bar member and is screwed into a threaded recess 138 formed in a U-shaped cut-out portion 140 of the sealer unit 44. The other end of the bar member 130 includes a mounting bracket 142 for holding a tubular guide member 144 which receives the assembled carrier tape system 10 and passes the same to the take-up storage reel 46.

From the foregoing detailed description, it can thus be seen that the present invention provides an improved carrier tape system in which the base strip and the cover strip are mechanically interengaged so that they are permitted to slide or creep relative to each other when wound around a storage reel, thereby eliminating the problem of stresses. Further, there is provided an apparatus for forming the present carrier tape system which can be readily achieved by modification or retrofitting of existing carrier tape joining apparatuses by replacing of several component parts at its joining station.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A mechanism for joining a carrier tape cover strip to a base strip having opposed first and second edges, said cover strip being of the type having a top surface with a longitudinally extending hump projecting upwardly therefrom and a pair of first and second sidewalls extending downwardly from said top surface in a parallel relationship to said hump, said first sidewall having a first inwardly extending hooked portion formed integrally therewith, said second sidewall having a second inwardly extending hooked portion formed integrally therewith, said mechanism comprising:

first guide means for receiving said base strip;

second guide means arranged in a position over said first guide means for receiving said cover strip above said base strip;

third guide means interposed between said first guide means and said second guide means for gradually guiding said first hooked portion of said cover strip over said first edge of said base strip;

holding means for retaining said first hooked portion and said first edge in place; and pressure means for applying a downward force on said hump to cause said second sidewall and said second hooked portion to move laterally outwardly, whereby when said pressure means is released said second hooked portion of said cover strip is snapped inwardly towards and over said second edge of said base strip.

2. A mechanism as claimed in claim 1, wherein said first guide means comprises a longitudinally extending channel.

3. A mechanism as claimed in claim 1, wherein said second guide means comprises a cover strip guide device formed of a raised, inwardly sloping plate member and a top member positioned over said plate member.

4. A mechanism as claimed in claim 1, wherein said third guide means comprises a thin arcuate guide plate.

5. A mechanism as claimed in claim 1, wherein said holding means comprises a plurality of pressure rollers and guide rollers.

6. A mechanism as claimed in claim 1, wherein said pressure means comprises a vertically aligned pressure roller.

7. A mechanism as claimed in claim 1, further comprising pulling means for pulling said cover strip at the same rate as said base strip is moved by a driven sprocket wheel.

8. A mechanism as claimed in claim 7, wherein said pulling means includes a cover strip pulling mechanism formed of a driven wheel synchronized to said drive sprocket wheel and engaging opposite sides of said hump of said cover strip to assist in driving of the same.

9. A mechanism as claimed in claim 1, wherein said first guide means comprises a longitudinally extending channel and said second guide means comprises a cover strip guide device formed of a raised, inwardly sloping plate member and a top member positioned over said plate member.

10. A mechanism as claimed in claim 9, wherein said third guide means comprises a thin arcuate guide plate.

11. A mechanism as claimed in claim 10, wherein said holding means comprises a plurality of pressure rollers and guide rollers.

12. A mechanism as claimed in claim 11, wherein said pressure means comprises a vertically aligned pressure roller.

13. A mechanism as claimed in claim 12, further comprising pulling means for pulling said cover strip at the same rate as said base strip is moved by a driven sprocket wheel.

14. A mechanism as claimed in claim 13, wherein said pulling means includes a cover strip pulling mechanism formed of a driven wheel synchronized to said drive sprocket wheel and engaging opposite sides of said hump of said cover strip to assist in driving of the same.

15. A mechanism for joining a carrier tape cover strip to a base strip having opposed first and second edges, said cover strip being of the type having a top surface with a longitudinally extending hump projecting upwardly therefrom and a pair of first and second sidewalls extending downwardly from said top surface in a parallel relationship to said hump, said first sidewall having a first inwardly extending hooked portion formed integrally therewith, said second sidewall having a second inwardly extending hooked portion formed integrally therewith, said mechanism comprising:

first guide means for receiving said base strip:

second guide means arranged in position over said first guide means for receiving said cover strip above said base strip; and sealing means for sequentially guiding said first hooked portion of said cover strip over said first edge of said base strip, for applying a downward force on said hump to cause said second sidewall and said second hooked portion to move laterally outwardly, and for subsequently releasing said downward force to effect the snapping of the second hooked portion of said cover strip over said second edge of said base strip, whereby said first and second edges of said base strip are loosely retained in their respective first and second hooked portions of said cover strip so as to permit said base and cover strips to slide relative to each other when wound on a storage reel.

16. A mechanism as claimed in claim 15, further comprising pulling means for pulling said cover strip at the same rate as said base strip is moved by a driven sprocket wheel.

* * * * *